United States Patent [19]

Zilbermann

[11] Patent Number: 4,633,937

[45] Date of Patent: Jan. 6, 1987

[54] METHOD AND APPARATUS FOR MULTI-ZONE AIR DISTRIBUTION SYSTEM

[75] Inventor: Andre H. Zilbermann, Dallas, Tex.

[73] Assignee: Brandt Engineering Company, Dallas, Tex.

[21] Appl. No.: 674,878

[22] Filed: Nov. 26, 1984

[51] Int. Cl.[4] ..... F24F 3/00

[52] U.S. Cl. ..... 165/22; 165/27

[58] Field of Search ..... 165/22, 27, 48.1

[56] References Cited

U.S. PATENT DOCUMENTS

| | | | |
|---|---|---|---|
| 2,238,689 | 4/1941 | Locke | 165/22 |
| 2,708,568 | 5/1955 | Marshall | 165/22 |
| 2,788,941 | 4/1957 | Crysler et al. | 236/1 |
| 3,179,162 | 4/1965 | McFarlan | 165/22 X |
| 3,307,618 | 3/1967 | Hagenauer et al. | 165/27 |
| 3,366,165 | 1/1968 | Beeler | 165/22 |
| 3,934,795 | 1/1976 | Ginn et al. | 165/27 X |
| 4,034,801 | 7/1977 | Bernstein | 165/48.1 |
| 4,102,494 | 7/1978 | Coleman et al. | 236/1 B |
| 4,473,107 | 9/1984 | Fairbrother et al. | 165/48.1 X |

*Primary Examiner*—Albert W. Davis, Jr.
*Assistant Examiner*—Randolph A. Smith
*Attorney, Agent, or Firm*—Richards, Harris, Medlock & Andrews

[57] ABSTRACT

A zoned HVAC system for a building is provided with three control zones: an internal zone (14), a perimeter zone (16) and a skin zone (18). The internal zone (14) provides cooling of internal heating loads from equipment and personnel as determined from internal zone (14) thermostats (43, 46, 48). Perimeter zone (16) provides cooling against interior and solar heating loads, with thermostats (51, 52, 53, 54) controlling associated sectors dampers (56, 57, 58, 59). The skin zone (18) provides both heating and cooling against thermal transmissions through the building exterior (10). Each skin zone sector (30, 31) is assigned to a plurality of perimeter zones (24, 25, 26, 27). Operation of a skin zone sector (e.g. 30) is effected by a control box (e.g. 64) receiving inputs from perimeter zone thermostats (e.g. 51, 52) with a control output functionally related to the perimeter zone sector with the lowest cooling demand.

20 Claims, 2 Drawing Figures

METHOD AND APPARATUS FOR MULTI-ZONE AIR DISTRIBUTION SYSTEM

TECHNICAL FIELD

This invention relates generally to heating, ventilating, and air conditioning (HVAC) systems and, more particularly, to methods and apparatus for controlling and sequencing the distribution of conditioned air in a multi-zone HVAC control system.

BACKGROUND OF THE INVENTION

HVAC systems have improved considerably in efficiency and utility from the early on-off systems where an entire volume was being conditioned as a function of a single thermostat. Building designs using skin facade structures and windows rather than more substantial exteriors tend to exaggerate thermal transmissions across the building exterior. Electrical office equipment and lighting can exhaust substantial heat, generally in the central area of a work space. Thus, heating and cooling requirements for an HVAC system tend to be a function of location within the volume served by the system.

With the advent of flexible control systems and the impetus of improved efficiency, zoned HVAC systems began to develop. Controlled zones can be arranged to provide for exterior spaces having a variety of solar heating loads and building thermal transmission loads and for interior spaces having a relatively constant and uniform cooling requirement from heat generated by the people, lighting and equipment in the interior space.

A typical early HVAC zoned system simply had two systems responding independently to the demands of the interior and exterior zones. One improvement was to space several exterior zones about the periphery to accommodate substantial changes in solar heat loads as a function of building exposure, seasonal changes and hourly variations in sun location. Typically, an interior zone has only cooling requirements and the air flow is controlled by dampers in air distribution ducts connected with a central air shaft. The exterior zone typically has a number of controllable sectors, with each sector having a thermostatic sensor, cooling air flow damper controls and an air heating system. The heating or cooling of each sector is controlled by the thermostatic sensor in that sector.

Applicant is also aware of a three zone HVAC distribution system. An interior zone is provided as described above. A first exterior zone is then provided around the interior zone to generally accommodate solar heating loads and a second exterior zone is provided about the first exterior zone to generally accommodate thermal transmissions through the building exterior facade. Each zone may include a plurality of sectors where each zone sector has a dedicated associated thermostatic control system. Further, each sector of each second exterior zone includes a heating system.

The three zone system generally described above offers some operational and efficiency improvements. However, a substantial amount of heating equipment is required to complete each second exterior zone sector. Further, adjacent sectors in a second exterior zone can become unstable where one sector is heating and the adjacent sector is cooling responsive to the heat input, and vice versa. A second exterior zone sector may even be trying to heat cooled air from the central air shaft.

These and other disadvantages of the prior art are overcome by the present invention, and an improved HVAC air transmission distribution and control system is provided.

SUMMARY OF THE INVENTION

A zoned HVAC system is provided for a building having an improved air distribution system. A perimeter duct zone is provided with a cooling capacity suitable for expected thermal radiative heating loads. Around the perimeter zone is a skin duct zone having both cooling and heating capacities sized for expected thermal transmissions through the building exterior facade.

Control inputs for the perimeter and skin duct zones are provided by a plurality of thermostats operatively located to control a corresponding plurality of perimeter zone sectors. The outputs of the thermostats are combined to obtain a single control signal for the entirety of a designated skin zone operatively assigned to a number of perimeter zone sectors.

It is a feature of the air distribution system according to one embodiment of the present invention that a designated skin zone has a single fan and heater unit serving a plurality of skin zone sectors.

It is another feature that the perimeter zone sector thermostatic output indicative of the greatest need for heating is selected to control the designated skin zone assigned to the perimeter zone sector.

It is yet another feature that the cooling output of the perimeter zone sectors will be damped closed before the skin zone heater is activated.

One other feature is deriving a control signal for the skin zone from a plurality of thermostats, each thermostat operatively located for controlling a perimeter zone sector.

These and other features and advantages of the present invention will become apparent from the following detailed description of the preferred embodiment, wherein reference is made to the figures in the accompanying drawings.

DETAILED DESCRIPTION OF THE PREFERRED EMBODIMENT

Figure 1:
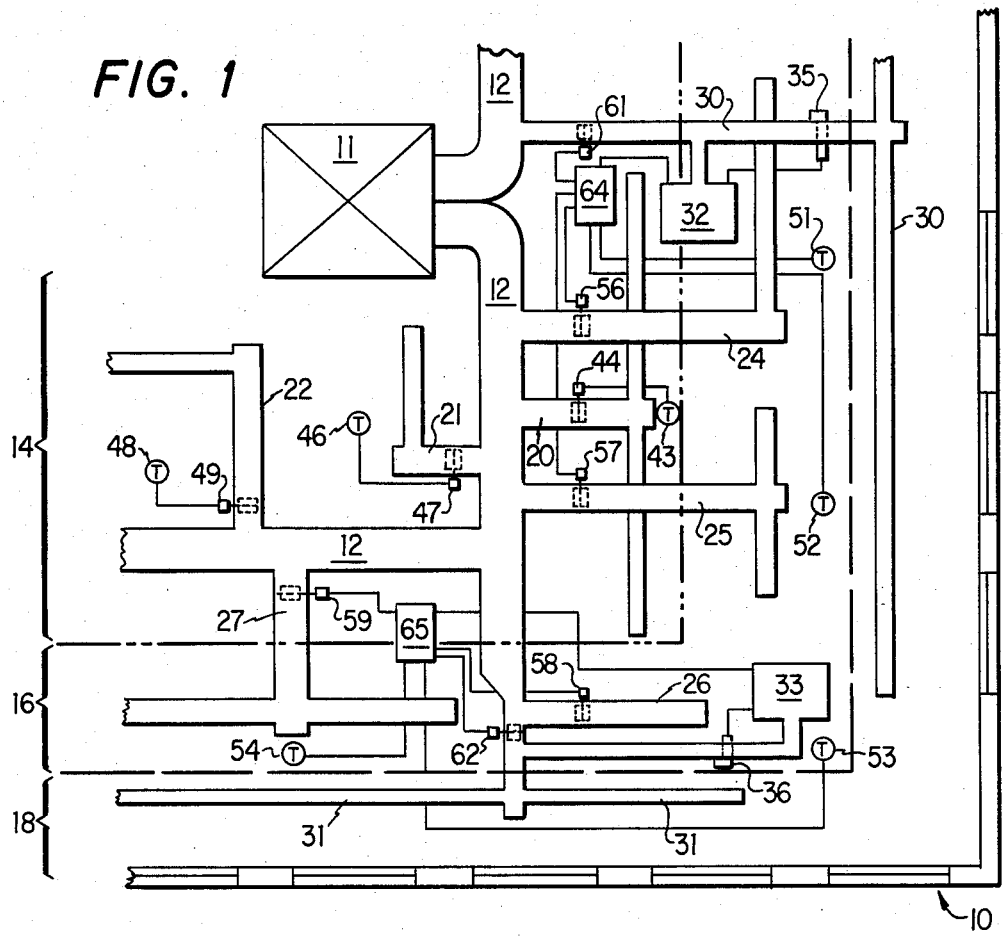
FIG. 1 is a mechanical schematic of one embodiment of an HVAC system in accordance with the present invention.

Referring now to FIG. 1, there is shown a mechanical schematic of a heating-ventilating-air conditioning (HVAC) system embodying the present invention. Building exterior 10 is provided with an HVAC system having three heat load zones defined therein. An internal zone 14 is provided for handling heat loads such as equipment, lighting, occupants, etc. typically generated at locations remote from building exterior 10. Perimeter zone 16 is provided to accommodate some mechanical heat loads and, additionally, solar heat loads from the radiative heating of the sun. Finally, skin zone 18 is provided to accommodate thermal loads from heat transmission through building exterior 10.

In a conventional HVAC system, mechanical shaft 11 operates as a downcomer for cooled air. The cooled air is moved by common fans located adjacent the cooling system (not shown). The cooled air is then provided to primary distribution ducts 12 and the distribution is thereafter controlled by dampers in control zones 14, 16 and 18. The operation and interaction of control zones 14, 16 and 18 according to the present invention afford increased efficiencies and economies.

Internal zone 14 primarily furnishes cooling in response to various internal mechanical heat loads, discussed above. Internal zone ducts 20, 21 and 22 are schematically shown for distributing conditioned air within internal zone 14. Actual air outlet registers and connecting flexible duct work to the outlet registers are not shown, and the actual location may be selected based on the architectural configuration and placement of heat generating equipment. Thermostats 43, 46 and 48 may be placed within selected locations of internal zone 14 for determining the zone cooling requirements. The thermostats may conveniently be pneumatic reverse-acting thermostats, as described below for other zones, to control damper actuators 44, 47 and 49 in ducts 20, 21 and 22, respectively.

Thus, internal zone 14 furnishes only cooled air in a quantity sufficient to maintain the output of thermostats 43, 46 and 48 within a preselected band about a desired temperature. As the heat load of internal zone 14 decreases, damper actuators 44, 47 and 49 act to close their respective dampers and reduce the cooled air volume being provided to internal zone 14. As shown herein, internal zone 14 is independent of zones 16 and 18 since it is not expected that internal zone 14 will require direct heating inputs to raise the zone temperature.

Perimeter zone 16 is the next control zone outward of internal zone 14. Perimeter zone 16 is also provided with cooled air flow from mechanical shaft 11 through primary distribution ducts 12. A plurality of sector distribution ducts 24, 25, 26 and 27 are provided for distributing cooled air within zone 16. Associated with sector ducts 24, 25, 26 and 27 are an additional plurality of outlet air registers and connecting flexible duct work. These items are omitted for clarity, but are also generally located in accordance with architectural considerations within the zone and the solar exposure of the adjacent building exterior.

Thermostats 51, 52, 53 and 54 are depicted within zone 16 for detecting temperatures within perimeter zone 16. As shown, thermostats 51, 52, 53 and 54 are operatively associated with perimeter zone sector duct systems 24, 25, 26 and 27, respectively. The output from sector thermostats 51, 52, 53 and 54 are provided to control boxes 64 and 65 with associated control system outputs for sector damper actuators 56, 57, 58 and 59, respectively. Thus, each perimeter zone sector thermostat will actuate a damper control in the perimeter zone sector duct system adjacent the thermostat to control the zone sector input air volume adjacent the input thermostat.

About the periphery of building exterior 10 is provided skin zone 18. Skin zone 18 is provided with cooling air from primary distribution ducts 12, as are perimeter zone 16 and internal zone 14. However, skin zone 18 further provides for distribution of heated air as necessary to control heat losses from the interior of the building through building exterior 10.

Skin zone duct systems 30 and 31 are provided with damper actuators 61 and 62 for controlling the cooling air flow. Again, a plurality of outlet air registers and associated flexible ducts are provided, although not shown in FIG. 1. However, skin zone duct systems 30 and 31 are further provided with air mixing boxes 32 and 33 and with skin zone heaters 35 and 36 for providing a heating air flow in addition to a cooling air flow. Air mixing boxes 32 and 33 are preferably similar to the apparatus disclosed in U.S. Pat. No. 3,951,205 to Zilbermann and U.S. Pat. No. 4,203,485 to Zilbermann and Aronoff. Heaters 35 and 36 may likewise be similar to the duct heaters described in these U.S. patents.

However, any suitable mixing box and duct heater may be used in accordance with the following functions. Mixing boxes 32 and 33 act to enable air from a return plenum to be recirculated back through skin zone ducts 30 and 31 to recover heat which would otherwise be exhausted from a return plenum. Typically, an air volume is located above a floor ceiling structure and serves as the return air plenum. Heated cooling air tends to naturally rise into the volume for removal or recirculation. As hereinafter explained, heaters 35 and 36 provide all the heating for the three zones 14, 16 and 18 and are energized when the heat available from the return air plenum (not shown) is less than the heat lost through the building exterior 10 and the temperature within perimeter zone 16 drops to actuate at least one sector thermostat 51, 52, 53 or 54, as shown in FIG. 1.

In a preferred operational sequence, the heating and cooling portions are cooperatively staged so that the system does not attempt to heat air which has first been cooled. Thus, as the temperatures begin to decrease in perimeter zone 16, the outputs from thermostats 51, 52, 53 and 54 act to close air flow dampers 56, 57, 58 and 59, respectively, to decrease the cooling air flow from perimeter zone sector ducts 24, 25, 26 and 27. The control systems and control boxes 64 and 65, hereinafter explained, select the lowest cooling demand from the perimeter zone sector duct systems to control air flow in the associated skin zone duct system. In a preferred embodiment, and to provide operational stability, the perimeter zone sector thermostat indicating the greatest demand for heating, or having the lowest temperature, controls the air flow and temperature from the skin zone duct system 30 and 31 assigned to the particular perimeter zone sector.

As hereinafter explained, as the thermostat outputs 51 and 52, for example, begin to indicate reduced sector temperatures, perimeter zone dampers 56 and 57 will begin to move toward a closed position. When one of perimeter zone damper 56 or 57 is fully closed, skin zone air flow damper 61 will begin to close. Where thermostats 51 and 52 indicate the need for additional heat input, the blower in air mixing box 32 cycles on, causing the mixing box back flow air damper to open to the return air plenum and circulate return air, which has been heated during circulation through the zones, through skin zone duct system 30. When skin zone damper 61 is fully closed, i.e., only return air is being circulated, and thermostat 51 or 52 shows a need for additional heat input, duct heater 35 will be activated to further heat the circulating air from air mixing box 32 for outlet through skin zone duct system 30.

Figure 2:
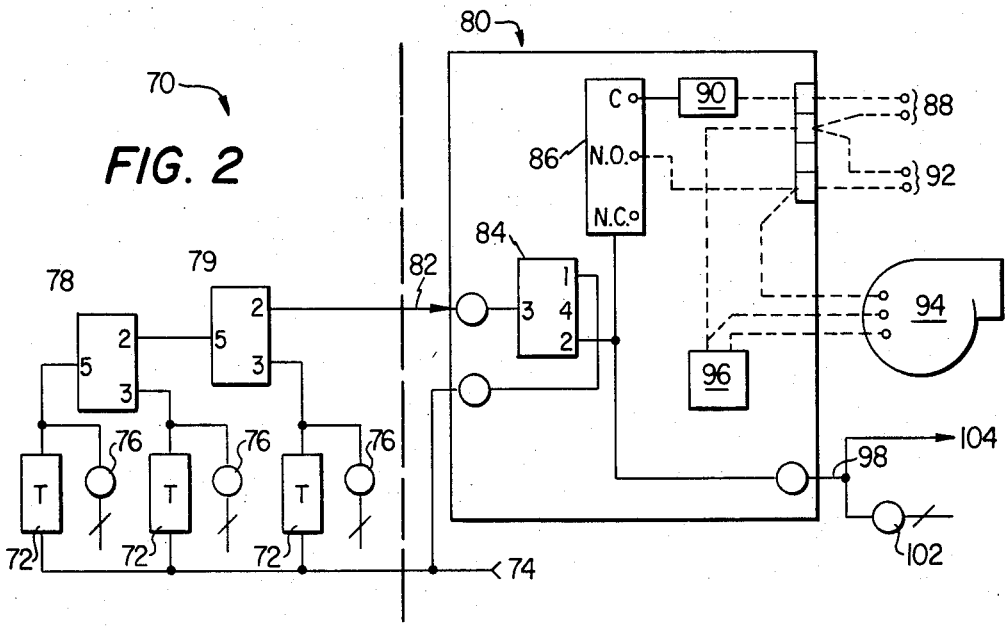
FIG. 2 is a schematic of a pneumatic-electrical control system for actuating a system as described in FIG. 1.

Referring now to FIG. 2, there is shown in schematic form a control system for carrying out the above operational sequence. Perimeter zone control system 70 includes sector thermostats 72, damper actuators 76 and relays 78, as hereinafter explained. Skin zone control system 80 includes a system of relays and switches for actuating the damper of the associated skin zone duct system, for activating the return air circulating fan and for energizing the skin zone duct heaters in a staged manner.

Perimeter zone control system 70 is depicted as having three thermostatic sector inputs 72. It will be appreciated that one thermostatic sector input 72 exists for each perimeter zone sector duct system (e.g., ducts 24, 25, 26 and 27 in FIG. 1). In a preferred embodiment, thermostat 72 is a reverse acting pneumatic thermostat (i.e., the control pressure appearing at the output of the thermostat decreases as the temperature increases). The input pressure is provided by main pneumatic line 74, which may conventionally be a pressure of 20 psi. The outputs from thermostat 72 are provided to damper actuators 76. Damper actuators 76 are preferably connected with normally open dampers so that an increasing pressure applied to damper actuators 76 will act to close the associated damper. Thus, a decreasing temperature will cause an increasing pressure output from thermostats 72 tending to move damper actuators 76 in a direction closing the associated damper.

As shown in FIG. 2, greater pressure relays 78 and 79 are provided. Greater pressure relays 78 and 79 take inputs at ports (5) and (3) and provide the greatest input pressure as the output pressure at port (2). Thus, with reverse acting thermostat 72, the greatest pressure is indicative of the lowest temperature and will appear at an output port (2). Greater pressure relay 78 is shown with two thermostatic sector inputs 72 which provide an input to greater pressure relay 79 at input port (5) in addition to a third thermostatic sector input 72 at port (3). The resulting output pressure at port (2) forms a single input signal 82 to skin zone control 80 having a pressure indicative of the lowest perimeter zone sector temperature.

Thus, while each thermostat 72 and perimeter zone control system 70 acts to operate its associated sector damper actuator 76 so that decreasing temperatures close the normally open dampers, a single output signal 82 is provided for an entire skin zone control 80. Input pneumatic signal 82 is directed to port (3) of sequencing pneumatic relay 84. The main pneumatic line pressure 74 is connected with input port (1) of relay 84. Sequencing relay 84 provides an output at port (2) such that for input pressure $P_1$, there is an output pressure $P_2$, where $P_2$ is greater than $P_1$.

In a typical embodiment, the main pressure is 20 pounds at port (1) and is regulated by the pressure appearing at port (3) to obtain the output pressure at port (2). A typical input signal 82 is in the range of 7–12 psi with an output pressure at port (2) regulated to be greater than input signal 82 but within the range of approximately 8–13 psi.

The output signal from sequencing relay 84 is provided as output pneumatic signal 98 to regulate skin zone damper actuator 102 and to provide control signal 104 to a pneumatic-electric relay energizing a series of duct heaters (heater 35 in FIG. 1). The signal at output port (2) of relay 84 is also provided to pneumatic-electric switch 86 to actuate electrical devices. Input power is provided at terminals 88. One terminal line is provided to a network of fuses and safety relays 90 to terminal "C" of switch 86. The electrical power connection to the duct heaters 92 and fan 94 is provided through switch 86 at the "NO" contact where the connection between the "C" and the "NO" contacts is provided by pneumatic actuation of switch 86.

Thus, through reverse acting thermostat 72, the pneumatic pressure applied to switch 86 increases as the temperature decreases. When a selected pressure is obtained, switch 86 closes the contact between terminals "C" and "NO" to provide power to a duct heater interlock at terminals 92 and to energize fan 94 through starting capacitor 96.

As hereinabove explained, fan 94 is energized, causing heated return air to be recirculated through skin zone ducts 30. The pressure relationships for actuating damper controller 102, fan 94 and the heaters through signal 104 are such that damper actuator 102 is about 50% closed before fan 94 is actuated through switch 86. Pneumatic signal 104 is provided to a plurality of pneumatic-electric switches, similar to switch 86, which energize heater elements in stages as the temperature decreases. The first heating stage is sequenced to actuate after damper actuator 102 has fully closed, fan 94 has attempted to recirculate return air and the temperature sensed by thermostats 72 has continued to decrease.

It is apparent from the above description that a stable HVAC distribution system is obtained in the above arrangement. Skin control system 80 begins to provide heated input only after the cooling damper is closed in the associated skin zone and after return air flow has been established to use floor exhaust heat carried by the circulating air. Thus, thermostats in perimeter zone 16 (FIG. 1) are not trying to furnish cooling air at the same time the heating system in skin zone 18 is trying to heat skin zone 18. It is also generally preferred to locate a skin zone 18 duct (e.g., duct 30) adjacent the same portion of building exterior 10 as the associated perimeter zone 16 duct sectors (e.g., ducts 24 and 25) to further coordinate thermal load requirements and stabilize operations of the adjacent zones.

Further, the zoned system depicted in FIG. 1 permits a minimum of heating equipment to be utilized. The only heating equipment is provided in a skin zone 18 and only one air mixing box and one heating section (for example, air mixing box 32 and heating element 35) are provided for a skin zone associated with a plurality of perimeter zone sectors. Internal zone 14 is a substantially independent zone having thermostats generally removed from the heating and cooling associated with perimeter zone 16 and skin zone 18. Each internal zone 14 duct system simply has a thermostat, which may conveniently be a reverse acting pneumatic thermostat, acting on a damper actuator to close the damper as the temperature decreases, indicating a reduction in the need for cooling air flow; see, for example, internal zone duct 22 with thermostat 48 and associated damper control 49.

As many possible embodiments may be made of this invention without departing from the spirit or scope thereof, it is to be understood that all matters herein set forth and depicted in the accompanying drawings are to be interpreted as illustrative and not in any limiting sense.

What is claimed is:

1. An air conditioning and distribution system, comprising:

(a) an interior distribution zone, including a plurality of first controllable dampers for distributing and regulating cooled air, and a first thermostatic controller for each said first controllable damper;

(b) a skin distribution zone, including a second controllable damper for regulating the overall flow of cooled air through said skin zone, a controllable air mixing box having a return air fan, and a heater downstream of said second controllable damper and said mixing box;

(c) a perimeter distribution zone, including a plurality of third controllable dampers, and a second thermostatic controller for each said third controllable damper; and (d) thermostatic control means independent of said interior distribution zone for said skin distribution zone including means for deriving a single skin control output from said second thermostatic controllers indicative of a selected thermal load in said perimeter zone for regulating said second controllable damper, said air mixing box, and said heater.

2. The system according to claim 1, wherein said themostatic control means further includes means for actuating said return air fan after said single skin control output indicates a selected reduction in temperature adjacent one of said second thermostatic controllers.

3. The system according to claim 2, wherein said thermostatic control means includes means for energizing said heater after said single skin control output indicates closure of said second controllable damper.

4. In a zoned HVAC system comprising a skin zone and a perimeter zone having a plurality of sectors, an improved air distribution system for a building, comprising:

a perimeter duct sized to accommodate cooling of at least solar radiation heating of said perimeter zone, said perimeter duct having a plurality of perimeter duct sectors controlled by a corresponding plurality of perimeter duct dampers, a skin duct sized to accommodate heating and cooling of thermal transmissions through an exterior skin of said building, said skin duct having a skin duct damper, a thermostatic control system located within said perimeter zone, said control system having an output for sequencing said perimeter duct dampers and said skin duct damper to control respective thermal loads.

5. The HVAC air distribution system according to claim 4, wherein said thermostatic control system generates a sector temperature signal corresponding to a temperature in each of said perimeter zone sectors.

6. The HVAC air distribution system according to claim 5, wherein said thermostatic control system includes relays for selecting a sector temperature signal indicative of a lowest temperature of said plurality of perimeter zone sectors for controlling at least said skin duct damper.

7. The HVAC air distribution system according to claim 6, wherein said skin duct further includes a duct heater and a fan for recirculating air from a return plenum.

8. The HVAC air distribution system according to claim 7, wherein said thermostatic control system reduces cooling air flow in each said damper controlled perimeter duct sector as said perimeter zone sector temperature decreases.

9. The HVAC air distribution system according to claim 8, further including heating signal means for actuating said recirculating air fan after said thermostatic control system produces an output signal to close at least one of said perimeter duct dampers.

10. The HVAC air distribution system according to claim 9, further including means for actuating said duct heater after said selected sector temperature signal has obtained a value effective to close said skin duct damper.

11. In an air conditioning and distribution system having a plurality of thermal load zones, an improved heating configuration, including:

a skin zone air distribution duct system for providing heating and cooling air, a plurality of perimeter zone sector air distribution duct systems in functional proximity with said skin zone duct system for providing only cooling air, a thermostatic control system having a plurality of individual sector thermostats within said perimeter zone, each of said thermostats regulating one of said perimeter zone sector air distribution duct systems, and means for deriving a single control signal for said skin zone air distribution duct system from said plurality of perimeter zone sector thermostats.

12. A system according to claim 11, wherein said skin zone air distribution duct system includes an airbox having a fan and back draft damper for recirculating air, a duct heater located downstream of said airbox, and a controllable damper located upstream of said airbox for admitting cooled air.

13. The system according to claim 12, wherein each of said perimeter zone sector air distribution duct systems includes a controllable damper in functional relationship with one of said thermostats.

14. The system according to claim 13, wherein said means for deriving a single control signal for said skin zone includes a first switch for actuating said fan responsive to a signal indicative of closure of one of said perimeter zone dampers.

15. The system according to claim 14, wherein said means for deriving a single control signal for said skin zone further includes a second switch for actuating said duct heater responsive to a signal indicative of closure of said skin zone controllable damper.

16. A method for controlling a zoned HVAC system in a building including the steps of:

providing a first cooling air flow to a perimeter zone effective to cool at least solar radiation heating, providing a second air flow to a skin zone to accommodate heating and cooling of thermal transmissions through an exterior skin of said building, detecting a plurality of temperatures within said perimeter zone, producing a plurality of perimeter control signals for controlling said first air flow, and providing from said plurality of detected temperatures a single skin control signal for controlling said second air flow.

17. The method according to claim 16, further including the steps of:

applying each of said perimeter control signals to corresponding perimeter dampers, said dampers controlling said first air flow to affect said perimeter zone temperatures, applying said single skin control signal to a skin damper controlling said second air flow.

18. The method according to claim 17, further including the step of applying said single skin control signal to actuate a fan in said skin zone after said single skin control signal indicates closure of one of said perimeter dampers.

19. The method according to claim 18, further including the step of applying said single skin control signal to actuate a heater in said skin zone after said single skin control signal indicates closure of said skin damper.

20. An air conditioning and distribution system for a building, comprising:

a main duct system in said building, means for producing a flow of cooled air in said main duct system, a return air plenum to collect and remove air heated by thermal loads affecting said building, an interior conditioning zone having a plurality of interior distribution ducts for receiving air from said main duct system for accommodating thermal loads generated within said building, a perimeter conditioning zone having a plurality of perimeter distribution ducts for receiving air from said main duct system for accommodating solar thermal loads radiated into said building, each of said interior distribution ducts and said perimeter distribution ducts having an associated controllable damper and an associated thermostat located to generate a first control signal for said associated damper, a skin conditioning zone having a skin distribution duct system operatively associated with a selected sector of said plurality of perimeter distribution ducts and comprising a single controllable skin damper, an airbox for recirculating air from said return air plenum, and a duct heater for heating said return air, and control means for deriving a skin control signal for said skin distribution duct system to sequentially actuate said skin damper, said airbox, and said duct heater.

* * * * *